United States Patent [19]

Hutter

[11] 4,172,601

[45] Oct. 30, 1979

[54] SLIDE ARRESTER FOR SKI POLE

[76] Inventor: Peter S. Hutter, P.O. Box 157, Aspen, Colo. 81611

[21] Appl. No.: 888,172

[22] Filed: Mar. 20, 1978

[51] Int. Cl.[2] ..... A63C 11/22

[52] U.S. Cl. ..... 280/11.37 H

[58] Field of Search ..... 280/11.37 E, 11.37 H, 280/11.37 B, 11.37 R; 135/66

[56] References Cited

U.S. PATENT DOCUMENTS

| | | | |
|---|---|---|---|
| 1,624,591 | 4/1927 | Fleming | 135/66 |
| 3,350,111 | 10/1967 | Sahlein et al. | 280/11.37 E |
| 3,862,765 | 1/1975 | Goheen | 280/11.37 H |
| 4,062,554 | 12/1977 | Korger | 280/11.37 D |

FOREIGN PATENT DOCUMENTS

| | | | |
|---|---|---|---|
| 62063 | 4/1892 | Fed. Rep. of Germany | 135/66 |
| 2618723 | 11/1977 | Fed. Rep. of Germany | 280/11.37 H |
| 1285357 | 1/1962 | France | 280/11.37 E |
| 2342679 | 9/1977 | France | 135/66 |

*Primary Examiner*—David M. Mitchell

[57] ABSTRACT

A slide arrester mounted on a ski pole near the handle grip, comprising an arcuately-shaped blade pivotable between stowed and projected positions. A spring arm yieldably holds the blade in either position with an overcenter snap action, while a cutting tip formed on the free end of the blade is sheathed in a recess in the handle grip in the stowed position.

6 Claims, 5 Drawing Figures

SLIDE ARRESTER FOR SKI POLE

BACKGROUND OF THE INVENTION

This invention relates generally to skiing apparatus and, more particularly, to a novel slide arrester incorporated on a ski pole.

A typical ski pole includes an elongated shaft with a pointed end for penetrating the snow, a snow disc encircling the shaft near the pointed end to limit its penetration, and a handle grip at the opposite end for grasping by a skier's hand. In the sport of snow skiing, ski poles have been in use by skiers for a long time as an aid in skiing, both to help maintain balance and to maneuver, as well as to assist in propelling the skier across the snow. Also, ski poles have been effective in assisting skiers who have fallen in righting themselves.

Upon falling, it often happens that a skier will commence sliding down a ski slope and will experience difficulty in stopping, particularly if the slope is steep or the ski surface is hard or icy. In these circumstances, a danger of injury to the fallen skier due to tumbling or obstructions on the ski slope and to other skiers in the path of the fallen skier is created. At the least, the fallen skier may be greatly inconvenienced by having lost a ski, ski pole or other paraphernalia at some point and sliding a substantial distance from same before stopping.

Hence, there is a need for a slide arrester that can be carried easily by a skier and be maintained readily available for use after a fall in halting or arresting slides down a ski slope. The primary objective of the present invention is a novel slide arrester that is incorporated on a ski pole to fulfill this need.

SUMMARY OF THE INVENTION

Briefly, and in general terms, the present invention resides in a pick-like device which is mounted on a ski pole for selective use by a skier to halt or arrest his sliding after a fall. This slide arrester is carried in a normally stowed position to prevent interference with normal use of the ski pole and can be projected by selective motion of the skier's hand, without releasing his grasp of the ski pole, for use in penetrating and gripping the ski surface after a fall.

More particularly, in the presently preferred embodiment, a rigid blade having means to penetrate and grip the ski surface is pivotably mounted on the ski pole near the handle grip for selective pivotal movement between a stowed and a projected position. In the stowed position, the blade is disposed in a folded state generally adjacent the handle grip, with clearance provided therebetween for the skier's hand. The means on the blade to penetrate and grip the ski surface include a relatively sharp cutting tip that nests in a recess in the handle grip when the blade is folded.

In the projected position, the blade is unfolded to project the cutting tip away from the handle grip and enable its use for penetrating the ski surface. Spring means comprising a spring arm with an over-center snap action tend to maintain the blade in either the stowed or projected positions and yield to pivotal movement between these positions in response to a relatively strong upward and outward flick of the skier's wrist. As a result, the slide arrester can be made operable by the skier without having to release his grasp of the handle grip.

It will be appreciated from the foregoing that the present invention provides a convenient and effective slide arrester which can be carried easily and selectively used by skiers to halt or arrest slides. Other aspects and advantages of the invention will become apparent from the following detailed description, taken in conjunction with the accompanying drawing, which illustrate, by way of example, the principles of the invention.

DETAILED DESCRIPTION

Figure 1:
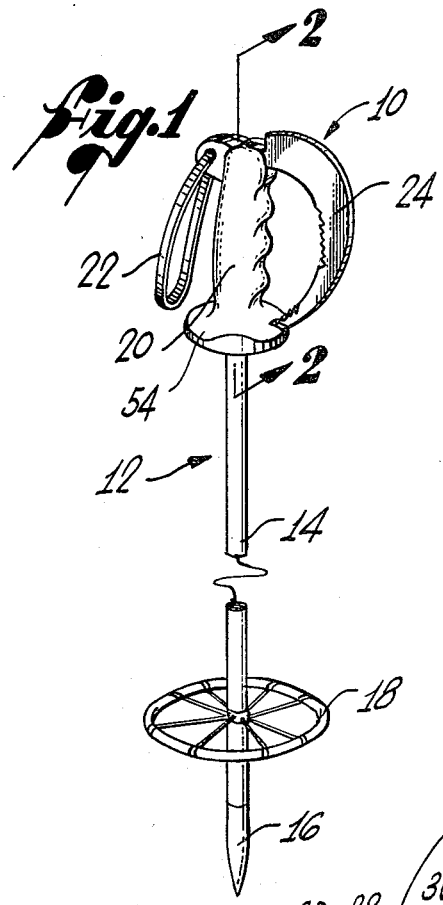
FIG. 1 is a fragmentary perspective view of a combined slide arrester and ski pole embodying the novel features of the present invention.

As shown in the drawing for purposes of illustration, the present invention is concerned with a slide arrester, indicated generally by the reference numeral 10 (FIG. 1), incorporated on an illustrative ski pole 12 for use by a skier to halt or arrest sliding after a fall. The ski pole comprises an elongated shaft 14 having a lower end 16 that is pointed for penetrating the ski surface, a snow disc 18 encircling the shaft and fastened thereto near its pointed end to limit penetration, and a handle grip 20 molded about the shaft at its upper end for grasping by a skier's hand. Also shown is a wrist strap 22, secured near the handle grip in a manner to be described, through which the skier can slide his hand to minimize the risk of losing the ski pole while skiing.

The illustrative ski pole 12 as thus far described is well known and further details of its construction are furnished hereinafter only as necessary to describe the invention. In accordance with the present invention, the slide arrester 10 is carried near the handle grip 20 on the ski pole in a manner that permits it to be safely stowed while skiing, yet readily and quickly available to assist the fallen skier in arresting a slide.

Figure 2:
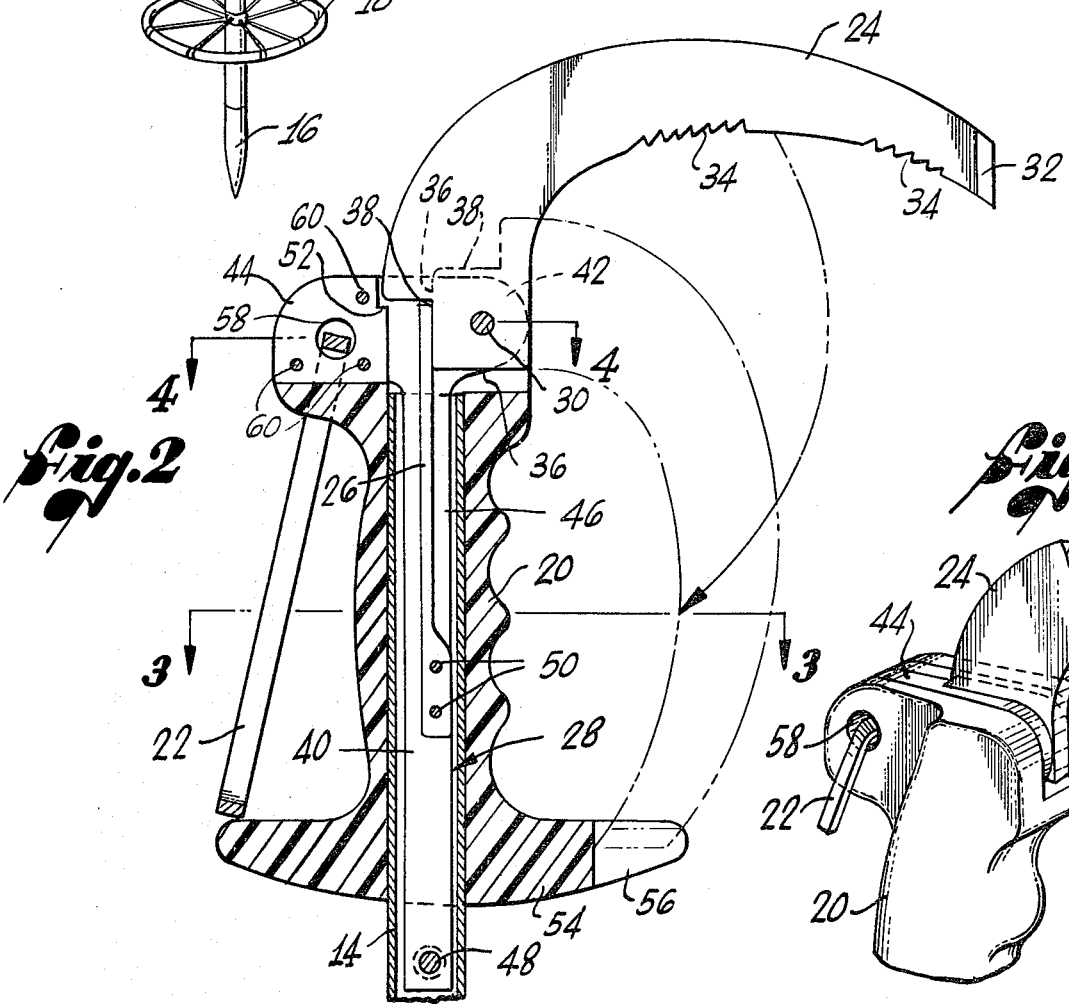
FIG. 2 is an enlarged, fragmentary cross-sectional view taken substantially along line 2—2 of FIG. 1, the unfolded position of the blade being shown in full and the folded position of the blade in broken lines.

More particularly, and in a present preferred embodiment, the slide arrester 10 comprises a flat and relatively thin blade 24 and a spring arm 26 that are mounted to a support 28 near the handle grip 20 to enable pivotal reciprocation of the blade between folded and unfolded positions with an over-center snap action (FIG. 2). It is an important feature of the invention that the spring arm 26 holds the blade 24 in either of its two positions, but yields to movement therebetween in response to a strong upward and outward flick of the skier's wrist that imparts a centrifugal force to the blade about its pivot point. Consequently, the blade is held in the folded or stowed position while skiing, yet the skier can unfold it without releasing his hold on the handle grip, to use the slide arrester for halting or arresting his sliding after a fall.

As shown in FIGS. 1 and 2, one end of the blade 24 is pivotably mounted to the support 28 by means of an axle 30 and the opposite end of the blade defines a relatively sharp cutting tip 32 for effective penetration of icy or snow-covered surfaces. Between its ends, the blade 24 is curved or arcuately shaped to provide clearance for the skier's hand between the handle grip 20 and the blade when folded. The shape of the blade 24 also improves its angle of penetration into the ski surface when projected in the unfolded position and, in combination with a plurality of serrations 34 along the inner arcuate edge, heightens the blade's grip after penetration. Of course, the blade is formed of a suitably hard and non-corrosive material, such as a lightweight corrosion resistant metal.

At the pivoted end of the blade 24 first and second flat abutment surfaces 36, 38 are formed along the blade's edge adjoining at a right angle, that coact with the spring arm 26 in a manner described below to produce the aforementioned over-center snap action. Herein, the abutment surfaces are substantially equal in size and equidistant from the axle 30.

The support 28 is generally T-shaped and comprises an elongated upright 40 and a pair of laterally disposed first and second shoulders 42, 44 integrally formed on one end thereof. A slot 46 is provided along a portion of the upright and extends entirely through the first shoulder 42 to accommodate the blade and the spring arm. To secure the support to the ski pole 12, an opening in the upper end of the shaft 14 exposes a hollowed-out portion into which the upright is fully received, with the shoulders overlying the shaft and the handle grip 20. The support is secured to the shaft by means of a rivet 48 through the upright.

Figure 3:
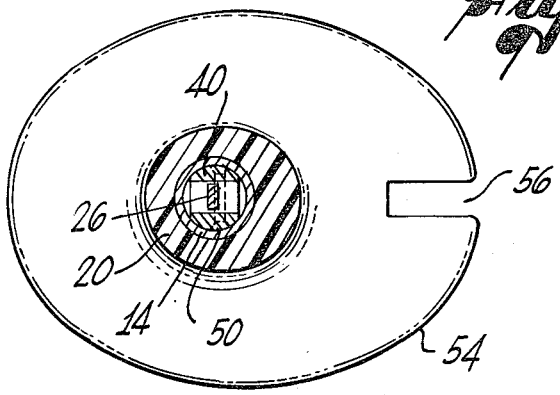
FIG. 3 is an enlarged cross-sectional view taken along line 3—3 of FIG. 2.
Figure 4:
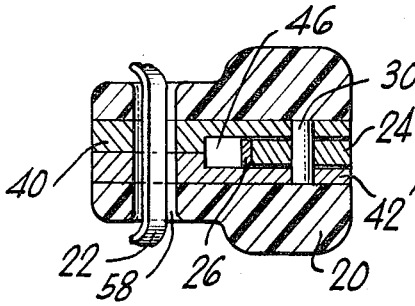
FIG. 4 is an enlarged cross-sectional view taken along line 4—4 of FIG. 2.

The pivoted end of the blade 24 is disposed edgewise within the slot 46, journalled in the first shoulder 42 by the axle 30, with its abutment surfaces 36, 38 protruding into the upright portion of the slot. The spring arm 26 is disposed longitudinally in the slot along the upright 40, with a thickened end portion anchored by pins 50 to the upright (FIGS. 2 and 3) and an opposite end pressed against one of the abutment surfaces 36 or 38 (FIGS. 2 and 4).

The broken lines in FIG. 2 show the blade 24 in its folded position, generally adjacent to the handle grip 20, and the end of the spring arm 26 pressed flat against the first abutment surface 36. It will be appreciated that pivoting of the blade 24 to its unfolded position generally normal to the handle grip 20 (shown in full lines) necessitates displacement of the spring arm 26 by the first abutment surface 36 until the corner formed with the second abutment surface 38 can pass thereby. Of course, the return force exerted by the spring arm 26 increases as it is displaced and results in snapping the blade 24 into the unfolded position, due to a release of the stored energy in the spring arm 26, as the corner between the abutment surfaces moves through the center of its travel. After snapping to the new position, the blade 24 tends to be held herein by the bias exerted on the second abutment surface 38 from the spring arm 26.

In the present invention, the afore-described pivoting action can be achieved by the skier's hand with a strong upward and outward flick of the wrist that is truncated sharply to impart enough centrifugal force to the blade 24 to overcome the return force of spring arm 26. Pivoting the blade 24 between positions in this manner depends upon selection of the strength of the spring arm 26, the displacement needed by the abutment surfaces 36, 38, and the shape and mass of the blade.

Figure 5:
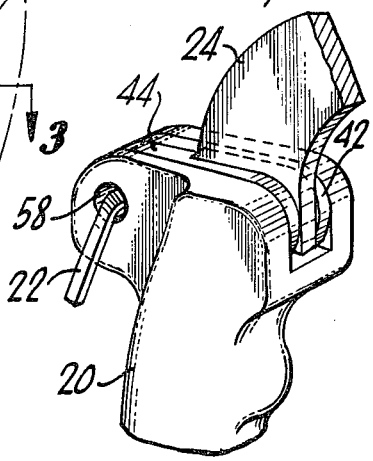
FIG. 5 is an enlarged, fragmentary perspective view of one end of the ski pole, showing the blade in the unfolded position.

Limit stops are provided in each position of the blade 24 to assist the spring arm 26 in holding it in the desired position. In the unfolded position, a lip 52 is formed along the upper edge of the slot 46, against which a portion of the pivoted end of the blade abuts when unfolded (FIGS. 2 and 5). To limit inward folding of the blade against the handle grip 20, a hand guard 54 is integrally formed around the lower end of the handle grip, against which the cutting tip 32 abuts when the blade is folded. In a further aspect of the invention, the cutting tip is received within a recess 56 in the hand guard so that it is safely nested or sheathed during skiing.

The second shoulder 44 on the support 28 has a hole 58 through which the wrist strap 22 is laced. For ease of manufacture, the support 28 can be formed in two halves and joined together by pins 60 in the second shoulder 44, as well as by the axle 30, the rivet 48 and the spring arm pins 50 (FIGS. 2 and 4).

From the foregoing, it will be evident that the present invention provides a novel, simple and effective slide arrester incorporated on a ski pole for use by a skier in halting or arresting slides after a fall. It will also be evident that, while a specific embodiment has been illustrated and described, various modifications and changes may be made within the spirit and scope of the invention.

I claim:

1. A ski pole apparatus comprising:

a shaft;

a handle grip mounted at one end of said shaft;

an elongated, arcuately shaped blade having means for penetrating and gripping frozen surfaces;

support means carried by said shaft near said handle grip for mounting said blade, said blade having an end pivotably mounted to said support means to permit pivoting of the former between a folded and an unfolded position and, when disposed in the folded position, providing clearance about said handle grip for a skier's hand; and spring means cooperating with said blade end for yieldably holding said blade in either of said positions and for yielding to pivotable movement therebetween with an over-center snap action.

2. A ski pole apparatus as defined in claim 1, wherein said spring means yields to pivoting of said blade between said folded and unfolded positions in response to a prescribed movement of said shaft near said handle grip.

3. In a ski pole apparatus having a shaft and handle grip means near one end of said shaft for grasping by a skier's hand, the improvement comprising:

a blade having one end pivotably mounted near said handle grip means for selective pivotal movement of said blade between a folded and an unfolded position, said blade being disposed generally adjacent said handle grip means in the folded position and projecting away from said handle grip means in the unfolded position;

means defining a clearance between said blade and said handle grip means for the skier's hand when said blade is disposed in the folded position; and means on said blade for penetrating and gripping frozen surfaces when said blade is disposed in the unfolded position.

4. A ski pole apparatus as defined in claim 3, wherein said means on said blade for penetrating and gripping frozen surfaces includes a cutting tip defined by an end of said blade opposite said pivotable end, and said handle grip means includes a recess in which said cutting tip nests when said blade is disposed in the folded position.

5. A ski pole apparatus as defined in claim 3, and further including:

spring means cooperating with said blade for yieldably resisting pivotal movement of said blade between the folded and unfolded positions.

6. A ski pole apparatus as defined in claim 5, wherein said spring means yields to movement of said blade between the folded and unfolded positions in response to a prescribed motion of the skier's hand.

* * * * *